United States Patent [19]

Gerzon

[11] 4,151,369

[45] Apr. 24, 1979

[54] SOUND REPRODUCTION SYSTEMS

[75] Inventor: Michael A. Gerzon, Oxford, England

[73] Assignee: National Research Development Corporation, London, England

[21] Appl. No.: 854,039

[22] Filed: Nov. 22, 1977

[30] Foreign Application Priority Data

Nov. 25, 1976 [GB] United Kingdom ..... 49117/76

[51] Int. Cl.[2] ..... H04R 5/00

[52] U.S. Cl. ..... 179/1 GQ; 179/1 GP; 179/1 G

[58] Field of Search ..... 179/1 GQ, 1 G, 1 GP, 179/100.1 TP, 100.4 ST, 1 GA, 1 VE

[56] References Cited

U.S. PATENT DOCUMENTS

| | | | |
|---|---|---|---|
| 3,710,034 | 1/1973 | Murry | 179/1 GQ |
| 3,919,480 | 11/1975 | Fukami | 179/1 GQ |
| 3,961,276 | 6/1976 | Kurata | 179/1 GQ |
| 4,118,599 | 10/1978 | Iwahaka et al. | 179/1 GQ |
| 4,119,798 | 10/1978 | Iwahaka | 179/1 G |

FOREIGN PATENT DOCUMENTS

| | | | |
|---|---|---|---|
| 2023377 | 11/1971 | Fed. Rep. of Germany | 179/1 GQ |
| 2120889 | 11/1971 | Fed. Rep. of Germany | 179/1 GQ |

*Primary Examiner*—Kathleen H. Claffy
*Assistant Examiner*—Gerald L. Brigance
*Attorney, Agent, or Firm*—Cushman, Darby & Cushman

[57] ABSTRACT

A basic decoder designed to feed signals to at least three loudspeakers disposed at respective azimuths around a reference point at equal distances therefrom is modified to make it suitable for feeding loudspeakers at the same azimuths but at non-uniform distances from the reference point. Each output of the basic decoder is subject to a time delay proportional to the difference of time of travel of sound from the first pair of loudspeakers to the reference point and the time of travel of sound from the second pair of loudspeakers to the reference point, divided by the sum of said times of travel to an adder connected between the first velocity signal input and the corresponding high-pass filter.

7 Claims, 5 Drawing Figures

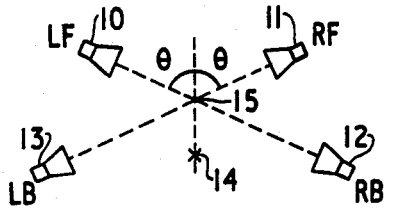
-FIG.1-
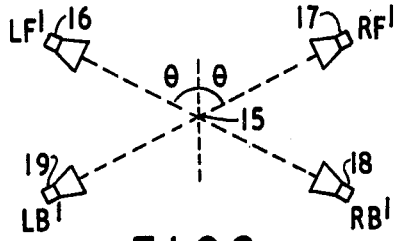
-FIG.2-
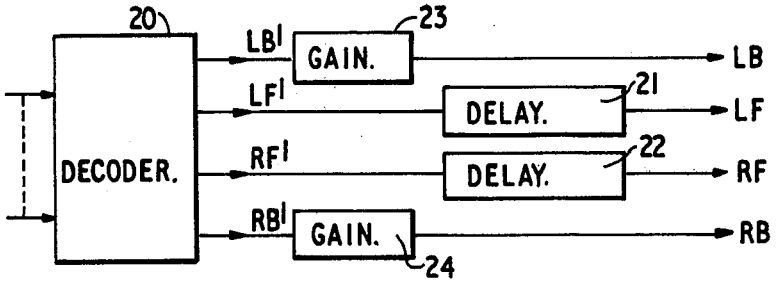
-FIG.3-
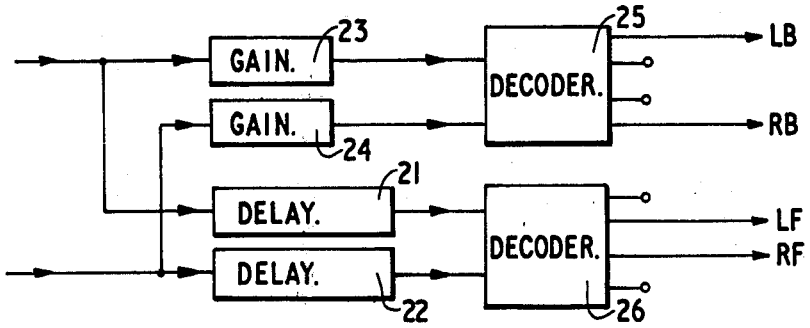
-FIG.4-
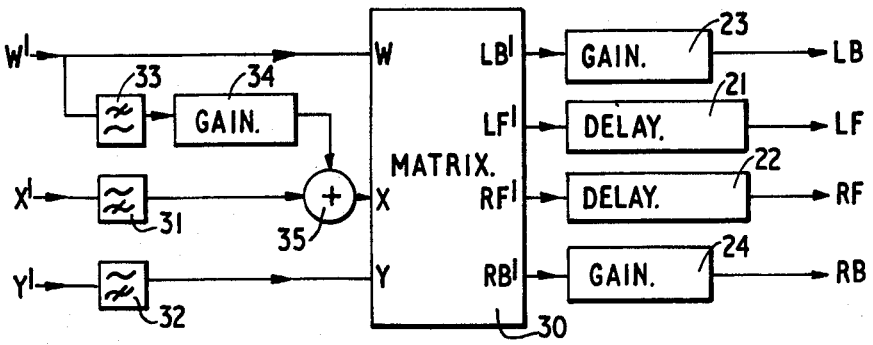
-FIG.5-

SOUND REPRODUCTION SYSTEMS

This invention relates to directional sound reproduction systems reproducing sound via three or more loudspeakers spaced round a listening position.

In designing decoders for sound reproduction systems of this type, it is customary to assume that all loudspeakers are at the same distance from a central listening point. The signals fed to the various loudspeakers are so adjusted as to produce a sound field in the immediate neighbourhood of this reference point which provides information to the ears of a listener at the point sufficient to create an impression of directionality. Provided that this information satisfies a sufficient number of the various mechanisms used by the human ear to localise sounds for listeners at the reference point, it is found in practice that good directional reproduction is obtained for listeners at other positions in the surrounding listening area.

The various relevant psychoacoustic criteria for a listener at the reference point are discussed in M. A. Gerzon, "Surround Sound Psychoacoustics", Wireless World, December, 1974, pages 483 to 486, U.K. Patent Specfication No. 1,494,751 and co-pending Application No. 46822/75 and corresponding U.S. Pat. Nos. 4,081,606 and 4,086,433. The latter two references disclose matrix circuitry for use in decoders for such systems.

It has been found that, even when all loudspeakers in a layout are equidistant from a reference point, there are some shapes of layout for which it is not possible to design decoders using matrix circuitry such that sufficiently many psychoacoustic criteria are satisfied for a listener at the reference point. In the following description, a loudspeaker layout for which it is possible to design a decoder using matrix circuitry will be referred to as a "solvable equidistant layout" and the decoder for such a layout will be described as a "solvable equidistant decoder".

According to the invention, there is provided a decoder for producing output signals which, if fed to at least three loudspeakers disposed at respective azimuths around a reference point at non-uniform distances therefrom, would produce a desired directional effect, comprising a basic decoder which, if fed to loudspeakers disposed at said azimuths at a uniform distance from the reference point would produce said desired directional effect, means for subjecting each output of the basic decoder to a relative time delay proportional to the difference between the distance from the reference point of the loudspeaker at the azimuth to which the output relates and the distance from the reference point of the most distant loudspeaker and to an amplitude gain proportional to the distance of the loudspeaker at said azimuth at the reference point.

The applied time delay is preferably so chosen as to be exactly equal to the difference in the time of travel of sound signals from each of the loudspeakers to the reference point. The constant of proportionality which determines the applied time delay is therefore at least approximately equal to the reciprocal of the speed of sound in air. The applied gain is chosen to compensate for the attenuation of sound intensity with increasing distance from a sound source.

It is already known to use delay lines to feed loudspeakers placed around a listener but these have been used to cause sounds other than those intended to come from loudspeakers in front of the listener to be heard by the listener with a delay relative to such sounds from loudspeakers in front of the listener of between 5 and 50 milliseconds. In accordance with the present invention, the sound from all loudspeakers arrive at the reference position at the same time from all loudspeakers. In addition, the invention requires the signals for the various loudspeakers to be produced by a solvable equidistant decoder for the same azimuth angles.

Embodiments of the invention will now be described by way of example with reference to the accompanying drawing, in which:

FIG. 1 is a schematic diagram of a loudspeaker layout suitable for use with a decoder in accordance with the invention, FIG. 2 is a schematic diagram of a solvable equidistant loudspeaker layout having the same azimuths as the layout shown in FIG. 1, FIG. 3 is a block diagram of a decoder in accordance with an embodiment of the invention, FIG. 4 is block diagram of a decoder in accordance with another embodiment of the invention, and FIG. 5 is a block diagram of a decoder similar to the decoder shown in FIG. 3 but having compensation for curvature of the sound field.

FIG. 1 shows a layout of four loudspeakers 10, 11, 12 and 13 equidistant from and surrounding a point 14. The loudspeakers are disposed at corners of a trapezium. There is no known way of designing a solvable equidistant decoder for this layout using, matrix circuitry with the point 14 as a reference.

The diagonal lines joining the loudspeakers 10 and 12 and loudspeakers 11 and 13 respectively intersect at a point 15. The loudspeakers 10 and 11 are closer to this point than are the loudspeakers 12 and 13 but, referring to FIG. 2, the loudspeakers 16, 17, 18 and 19 which are located on these diagonal lines at equal distances from the reference point 15, form a solvable equidistant layout. A decoder for this layout can be as described in either the above-mentioned patent specification or the above-mentioned co-pending application.

FIG. 3 shows a decoder in accordance with the invention. Two or more input signals are fed to a solvable equidistant decoder 20 which produces output signals LB', LF', RF' and RB' suitable for the loudspeakers 16, 17, 18 and 19 respectively of the layout shown in FIG. 2. The two output signals LF' and RF' for the front loudspeakers are fed to respective delay devices 21 and 22 which produce output signals LF and RF respectively for feeding to the loudspeakers 10 and 11 of the layout shown in FIG. 1. Similarly, the signals LB' and RB' are fed to respective amplifiers 23 and 24 which produce output signals LB and RB respectively for the loudspeakers 12 and 13. The delay applied by the delay device 21 is equal to the difference between the distance of the furthest loudspeaker, i.e. the loudspeaker 12 or the loudspeaker 13, from the reference point 15 and the distance of the loudspeaker 10 from the reference point 15 divided by the speed of sound in air. A similar delay is applied by the delay device 22. The amplifiers 23 and 24 apply amplitude gains which are proportional to the distance of each of the loudspeakers 12 and 13 from the reference point 15, the constant of proportionality being such that the equivalent gain for the distance of the loudspeakers 10 and 11 from the reference points 15 would be unity. More generally, for an array of loudspeakers in which the distance of the i'th loudspeaker from the reference point is $r_i$ and the maximum loudspeaker distance from the reference point is $r_{max}$ then i'th loudspeaker is fed from its associated solvable equidistant decoder output via an amplitude gain proportional to $r_i$ and a time delay given by:

$$(r_{max}-r_i)/c$$

where c is the speed of sound in air. Thus, the signal for the most remote loudspeaker will be fed via an amplifier only, the signal for the closest loudspeaker to the reference point would be fed via a delay device only while the signals for intermediate loudspeakers will be fed via both respective amplifiers and respective delay devices.

If desired, the various gains and time delays may be applied to the input signals to solvable equidistant decoders rather than to the output signals. FIG. 4 illustrates a decoder of this type which is equivalent to the decoder of FIG. 3 when the latter is adapted to receive two input signals only. One of the input signals is applied to the amplifier 23 and the delay device 21 and the other input signal is applied both to the amplifier 24 and the delay device 22. Two solvable equidistant decoders 25 and 26, both of which as identical with the decoder 20, are provided. The outputs from the two amplifiers 23 and 24 are applied to the inputs of the decoder 25, two of the outputs of which comprise the signals LB and RB respectively. The other outputs are not used. Similarly, the outputs of the delay devices 21 and 22 are applied to the inputs of the decoder 26, two of the outputs of which produce the signals LF and RF, the other two outputs not being used. In general, the delay devices and amplifiers may be incorporated in any part of the circuitry provided that the required output signals are produced.

Certain of the decoders described in the above-mentioned patent specification and co-pending application include so called "distance compensation" which compensates for the effect of the curvature of the sound field at the reference point due to the distance of the loudspeaker from the reference point being finite. Such compensation consists of an RC high-pass filter in all signals paths representative of reproduced velocity at the reference point with a −3dB point 54/r Hz, where r is the loudspeaker distance in meters. Decoders in accordance with the present invention are for use with loudspeaker layouts which do not have a single value for r. An economical, although not strictly correct, method of providing compensation of sound field curvature in decoders in accordance with the invention is to apply compensation for an average value of the loudspeaker distances involved.

It is in fact possible to compute the circuitry required to compensate for sound field curvature for layouts not equidistant from the reference point and this compensation can always be realised by a matrix using non-cascaded low-pass and high-pass RC networks acting on the signals representative of pressure and velocity to produce modified output signals representative of velocity.

FIG. 5 illustrates the later stages of a decoder, similar to the decoder of FIG. 3, with compensation for sound field curvature. Three input signals W', X' and Y' are representative respectively of the desired pressure, forward components of velocity and lateral components of velocity at the reference position. The distance compensated signals, W, X and Y are applied to the output matrix 30 of a solvable equidistant decoder for the layout of FIG. 2 which produces output signals as follows:

$$LB'=\tfrac{1}{2}(W-X+Y)$$
$$LF'=\tfrac{1}{2}(W+X+Y)$$
$$RF'=\tfrac{1}{2}(W+X-Y)$$
$$RB'=\tfrac{1}{2}(W-X-Y)$$

The output signals for the matrix 30 are applied to the delay devices 21 and 22 and the amplifier 23 and 24 to produce the signals LB, LF, RF and RB as described with reference to FIG. 2.

To provide the required distance compensation, the two inputs signals X' and Y' representative of velocity are applied to the matrix 30 via respective high-pass filters 31 and 32 with time constant given by:

$$2(t_1^{-1}+t_2^{-1})$$

where $t_1$ and $t_2$ are the time sound takes to travel from the two front loudspeakers 10 and 11 to the reference point 15 and from the rear loudspeakers 12 and 13 to the reference point 15 respectively, so that the −3dB frequency is equal to the average of that associated with the front loudspeaker distance and that associated with the rear loudspeaker distance. In addition, the pressure signal W' is RC low-pass filtered by a filter 33 having the same time constant as the filters 31 and 32, passed through an attenuator 34 having amplitude gain given by:

$$(t_2-t_1)/(t_2+t_1)$$

and added to the output of the filter 31 by an adder 35.

When the loudspeaker layout departs only slightly from being equidistant from the reference point, the required delays are small and may be provided by cascaded RC all-pass networks. For example if the required delay corresponds to a 20 centimeter difference between $r_i$ and $r_{max}$ an approximation to the required delay may be provided by a cascaded pair of RC all-pass networks, each of time constant equal to a quarter of the required delay, i.e. a time constant of 0.147 msec. The pair of all-pass networks acts as a delay of the required time for frequencies up to about 1 kHz. At higher frequencies, it does not alter the polarity of signals. It is considered to be desirable for good high frequency localisation that the relative polarities of signals from all loudspeakers should be undisturbed by the delay circuitry.

I claim:

1. A decoder for producing output signals which, if fed to at least three loudspeakers disposed at respective azimuths around a reference point at non-uniform distances therefrom, would produce a desired directional effect, comprising a basic decoder which, if fed to loudspeakers disposed at said azimuths at a uniform distance from the reference point would produce said desired directional effect, means for subjecting each output of the basic decoder to a relative time delay proportional to the difference between the distance from the reference point of the loudspeaker at the azimuth to which the output relates and the distance from the reference point of the most distant loudspeaker and to an amplitude gain proportional to the distance of the loudspeaker at said azimuth at the reference point.

2. A decoder according to claim 1, wherein the means for subjecting each output of the basic decoder to a time delay and an amplitude gain comprises means for applying such delay and gain directly to each output of the basic decoder.

3. A decoder according to claim 1, wherein the means for subjecting each output of the basic decoder to a time delay and an amplitude gain comprises means for applying respective time delays and gains to the inputs of the basic decoder.

4. A decoder according to claim 1, having means for providing outputs for four loudspeakers.

5. A decoder according to claim 4, having means for providing outputs for four loudspeakers disposed at respective corners of a trapezium with a first pair of loudspeakers at one distance from the reference point and a second pair of loudspeakers at another greater distance from the reference point.

6. A decoder according to claim 5, having an output matrix arranged to produce the output signals, a pressure signal input, a first velocity signal input for a signal representing the required velocity of sound in a first direction bisecting the angle subtended by the first pair of loudspeakers at the reference position and a second velocity input for a signal representing the velocity of sound in a direction perpendicular to said first direction, the velocity signal inputs being connected to the outputs of respective high-pass filters having time constant whose reciprocal equals the average of the reciprocals of the times taken by sound to travel from each of the loudspeakers to the reference point and a low-pass filter having the same time constant as said high-pass filters connected to apply the signal applied to the pressure signal input via means for applying a gain equal to the difference of time of travel of sound from the first pair of loudspeakers to the reference point and the time of travel of sound from the second pair of loudspeakers to the reference point, divided by the sum of said times of travel to an adder connected between the first velocity signal input and the corresponding high-pass filter.

7. A decoder according to claim 1, wherein the relative delay to which each output of the decoder is subject is equal to the difference between the distance of the corresponding loudspeaker from the reference point and the distance of the most remote loudspeaker to the reference point divided by the velocity of sound in air.

* * * * *